US006505374B1

(12) United States Patent
Weihrauch

(10) Patent No.: US 6,505,374 B1
(45) Date of Patent: Jan. 14, 2003

(54) ROLLER FOR APPLYING A MEDIUM, ESPECIALLY A PAINT ROLLER

(75) Inventor: Georg Weihrauch, Wald-Michelbach (DE)

(73) Assignee: Coronet-Werke GmbH, Wald-Michelbach (DE)

( * ) Notice: Subject to any disclaimer, the term of this patent is extended or adjusted under 35 U.S.C. 154(b) by 0 days.

(21) Appl. No.: 09/856,098

(22) PCT Filed: Oct. 19, 1999

(86) PCT No.: PCT/EP99/07924

§ 371 (c)(1),
(2), (4) Date: May 17, 2001

(87) PCT Pub. No.: WO00/30768

PCT Pub. Date: Jun. 2, 2000

(30) Foreign Application Priority Data

Nov. 26, 1998 (DE) ..... 198 54 561

(51) Int. Cl.[7] ..... B05C 1/00; B44D 5/00; A47L 17/00

(52) U.S. Cl. ..... 15/230.11; 492/13; 492/19

(58) Field of Search ..... 15/230.11; 492/13, 492/19

(56) References Cited

U.S. PATENT DOCUMENTS

| | | | |
|---|---|---|---|
| 1,934,751 | A | 11/1933 | von Webern |
| 2,904,813 | A | 9/1959 | Schleicher |

FOREIGN PATENT DOCUMENTS

| | | |
|---|---|---|
| DE | 652 666 | 11/1958 |
| DE | 25 024 | 4/1963 |
| DE | 94 18 194 | 12/1995 |
| DE | 44 40 393 | 5/1996 |
| FR | 2 172 820 | 10/1986 |

*Primary Examiner*—Robert J. Warden, Sr.
*Assistant Examiner*—Shay Balsis
(74) *Attorney, Agent, or Firm*—Paul Vincent

(57) ABSTRACT

A roller for the application of a coating medium, in particular a paint roller, has a support arm bearing a curved roller axle on which at least one application roller is borne for rotation. In order to be able to evenly and easily introduce a coating medium onto both a flat as well as a curved surface, the roller axle has a curvature which can be adjusted by an adjusting device, with the orientation of the adjusted curvature being fixed in each case.

14 Claims, 4 Drawing Sheets

ROLLER FOR APPLYING A MEDIUM, ESPECIALLY A PAINT ROLLER

BACKGROUND OF THE INVENTION

The invention concerns a roller for application of a medium, in particular a paint roller, with a support arm bearing the roller axle on which at least one application roller is borne for rotation.

Rollers are used in various areas for application of a coating medium. The application of paint is discussed herein by way of example although the invention could be utilized with other coating media in a similar manner.

In order to apply paint to a flat surface, conventional paint rollers comprise a support arm made from metal or plastic having a handle at the lower end thereof. The support arm is bent over at its upper end so that a substantially straight roller axle is formed extending perpendicularly with respect to the handle, on which one or a plurality of paint application rollers can be placed. In order to paint a surface, e.g. a wall, the paint roller and the paint application rollers are dipped into the paint and then passed over the surface to be painted, wherein the paint application rollers roll along the surface to thereby dispense paint. In this fashion, a flat surface can be rapidly and effectively painted. However, the painting of curved surfaces, e.g. pipes or corrugated plates is very tedious, since only very short sections of the straight paint application rollers seat on the curved surface.

Paint rollers have been developed for painting curved surfaces, the roller axles of which are curved in a particular predetermined direction. A plurality of short paint application rollers are placed onto the curved roller axle, disposed at angled orientations with respect to each other so that they seat on differing sections of the curved surface to be painted. This has, however, the disadvantage that the fixed predetermined curvature of the roller axle with the paint rollers can only be used to paint curved surfaces which have the same or at least similar curvature as the roller axle. In practice it has turned out that in order to paint pipes having a diameter between 50 mm to in excess of 1000 mm, a plurality of different paint rollers must be available. This creates storage problems and is also expensive. Should a deviation obtain between the radius of the curved surface to be painted and the radius of curvature of the roller axle, the paint application rollers only seat on the surface at sections or even at points which leads to increased local loads on the paint application roller and to associated irregular paint application. In addition, the orientation of the paint application roller relative to the handle is fixed so that it is difficult to use the roller under certain working conditions.

Also known in the art is the spreading-out of the support arm in a forked fashion at its forward end facing away from the handle and the spanning of a flexible spring between the free ends of the forked portion, upon which a plurality of paint application rollers are borne. In order to introduce paint onto a curved surface, the user presses the paint application rollers against the surface to be painted, wherein the curvature of the spring adjusts to the curvature of the surface to be painted. It has, however, turned out that the pressure which is to be introduced by the user to bring the roller into the desired curved shape, leads to an irregular and in particular a substantially point-like loading of the central paint application roller, as a result of which the paint contained in the paint application rollers is pushed out in a sideward direction making the paint application uneven and furthermore possibly leading to the running of paint. The unevenness of the paint application is further increased by the fact that the spring is unstable and does not have a defined curvature. Since the paint application rollers and the spring are captured by the forked portions of the support arm on both sides, it is not possible to introduce paint into corners. In addition, painting of pipes already mounted to a wall is practically impossible on the back side facing the wall. Additionally disadvantageously the orientation of the paint application roller relative to the handle cannot be changed which makes handling of the roller more difficult.

SUMMARY OF THE INVENTION

It is the underlying purpose of the invention to create a roller for application of a medium, in particular a paint roller, with which a coating medium can be applied evenly and easily to both a flat as well as to a curved surface.

This purpose is achieved in accordance with the invention with a roller of the above mentioned kind in that the curvature of the roller axle can be changed by an adjustment device and the adjusted curved orientation can be fixed in each case.

The adjustability of the curvature of the roller axis facilitates adjustment of the roller to the curvature of the surface to be covered so that both pipes having small diameters as well as pipes having large diameters can be advantageously painted using only one paint roller without having to have a plurality of paint rollers be available. Fixing of the roller axle by the user to an adjusted curved orientation can lead to a more even application of the paint, since the curvature of the roller axle is not dependent upon the pressure introduced by the user. Furthermore, the roller axle can be straight, so that the paint roller can also be used to paint flat surfaces in a conventional fashion.

The curvature of the roller axle is preferentially effected by applying a flexural moment of continuously changeable magnitude onto the roller axle using the adjustment device. The flexural moment can e.g. be effected by exerting an eccentric pressure and/or tension force on the roller axle, the eccentricity leading to a curving of the roller axle. So long as the forces generating the flexural moment are active, the roller axle is fixed in its curved position. With predetermined eccentricity for the tensioning forces, the continuous variation thereof facilitates an associated continuous adjustment of the curvature.

A preferred embodiment of the invention provides that the roller axle consists essentially of at least two parallel adjacently extending axle members of which at least one has a length which can be changed or adjusted relative to the other axle member using the adjustment device. The axle members are thereby connected to each other at certain locations and the curvature of the roller axle can be changed through a shorting or a lengthening of at least one of the axle members. When the adjustment device shortens the one axle member, this shortening results in a pressure force on the other axle member via an engagement section between the two axle members to effect curvature of the entire roller axle. If the length of the other non-adjustable axle member held by the support arm and the length of the adjustable axle member are equal, a linear orientation of the roller axle results. The adjusting device is preferentially a tension screw in threaded engagement with the adjustable axle member so that a rotation of the tension screw draws-in the adjustable axle member to thereby lead to a reduction in its instantaneous length, to curve the roller axle. Use of a tension screw also has the advantage that a continuous adjustment of the curvature can be effected in a simple manner.

Alternatively, it is also possible to subject the roller axle to an eccentric pressure and/or tensile force which e.g. can be effected by means of internal tension or pressure bands. The eccentricity leads to a curvature of the roller axle in dependence on the magnitude of the applied pressure or tensile force.

The axle components which can be adjusted relative to each other are preferentially connected to each other at their free ends facing away from the support arm and the tension screw and can slide freely in the intermediate region during adjustment. When the length of the adjustable axle member is shortened by rotating the tension screw, a pressure load acts on the stationary axle member at the opposite free end of the roller axis via engagement therewith, wherein there is no force transfer between these components in the intermediate portions of the axle members so that an even, continuous curvature of the roller axle can be achieved along its entire length.

The introduction of a flexural moment or an eccentric tensioning force can effect a curvature of the roller axle in a single plane. In order to increase the range of applicability of the paint roller, an improvement in the invention provides that the roller axle can be brought into various pivot locations relative to the support arm, as a result of which the plane of curvature of the roller axle can be adjusted relative to the support arm and thereby relative to the handle in order to optimally adjust the support arm to the instantaneous working conditions. Although it is possible to provide a continuous adjustment of the roller axle relative to the support arm, it has, in practice, turned out to be preferable when the roller axle can be latched into defined pivot positions preferentially in intervals of 30° or 45°.

It can be useful to have roller axles of differing axial lengths in dependence on the size of the curved surface to be covered. This can be achieved in accordance with the invention when the roller axle is held on the support arm in a detachable fashion so that it can be rapidly exchanged if necessary. This has the additional associated advantage that only one single support arm, with handle, must be provided for various roller axles upon which the desired roller axle can be mounted in each case.

A preferred embodiment of the invention provides that the application roller or rollers are held on the roller axle in an exchangeable fashion. A plurality of coaxially disposed partial rollers can thereby be provided. In this fashion paint application rollers made from differing materials and/or having differing surface shapes or structures can be utilized together or in sequence on a common paint roller. The paint application rollers are placed onto the roller axle at the free end thereof and preferentially held at this location via frictional forces. The paint application rollers are prevented from slipping off the roller axle by means of a stop member, e.g. a stop nut, disposed on an end of the roller axle. In order to remove the paint application rollers, the user must only detach the stop member from the roller axle and subsequently axially remove the paint application rollers therefrom.

The paint application rollers should be made from an elastic, flexible material in order to be able to precisely follow the curvature of the roller axle. In particular, longer paint application rollers thereby have only a small amount of resistance which must be overcome to curve the roller axle. This simplifies adjustment.

In order to be able to recycle the entire roller it is, in particular, completely made from plastic, wherein a further improvement therein can provide for the use of only one type of plastic.

Additional details and features of the invention can be seen in the following description of an embodiment with reference to the drawing.

DESCRIPTION OF THE PREFERRED EMBODIMENT

Figure 1:
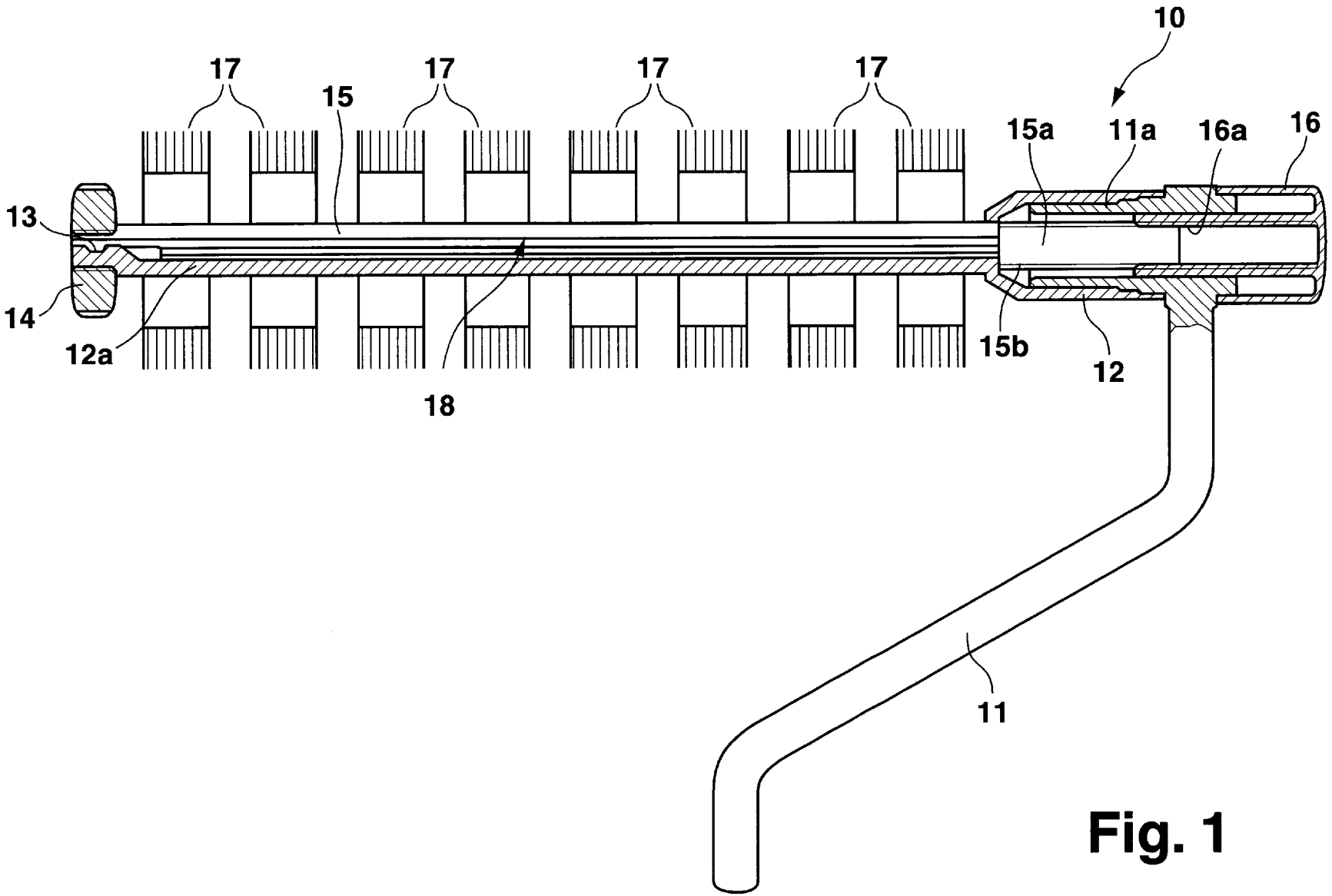
FIG. 1 shows a vertical section through a paint roller having paint application rollers mounted thereto and a straight roller axle.

A paint roller 10 shown in FIG. 1 comprises an angled support arm 11 having, as is conventional, a handle on its lower end (not shown). A bushing 11*a* is integrally formed on the preferentially plastic support arm 11 at the upper end thereof and extends substantially perpendicularly with respect to the handle to freely protrude from the support arm 11. A cup-like bushing member 12 fits closely over the bushing 11*a* and is latched thereto for rotation or pivoting relative to the bushing 11*a*. The position of the bushing member 12 on the bushing 11*a* is fixed by latching engagement in defined pivot positions of preferentially 45° intervals.

A first strip-like axle member 12*a* is firmly connected to the bushing member 12 and has an associated additional strip-like axle member 15. The two axle members extend parallel with respect to each other and constitute, taken together, a roller axle 18 for the paint roller. The second axle member 15 is guided on the first axle member 12*a* for displacement in the longitudinal direction and is in positive engagement with the first axle member 12*a* via an engagement nose 13 disposed on the front end facing away from the bushing member 12. The two axle members 12*a* and 15 can be formed as a single plastic piece, wherein they are connected to each other by a striplike joint at their front end.

A stop screw 14 is screwed onto the front end of the roller axle 15 or of the two axle members 15 and 12*a*.

A plurality of paint application rollers 17 can be placed onto the roller axle 18 formed from the two axle members 12*a* and 15 after the stop screw 14 has been removed from the roller axle. In the embodiment shown, eight substantially identical paint application rollers 17 are disposed on the roller axle at separations from another. Other conventional configurations of paint application rollers are, however, also possible. The stop screw 14 prevents, through positive engagement, the paint application rollers 17 from slipping axially off the roller axle 18. A threaded section 15*a* is formed on the second axle member 15 at the inner end facing the bushing 11*a* of the support arm 11 which is disposed within the bushing member 12 and within the bushing 11*a* of the support arm 11, and which engages a thread 16*a* of a tensioned screw 16 projecting into the bushing 11*a* and borne for rotation on the busing 11*a* at an end facing away from the bushing member 12.

Figure 2:
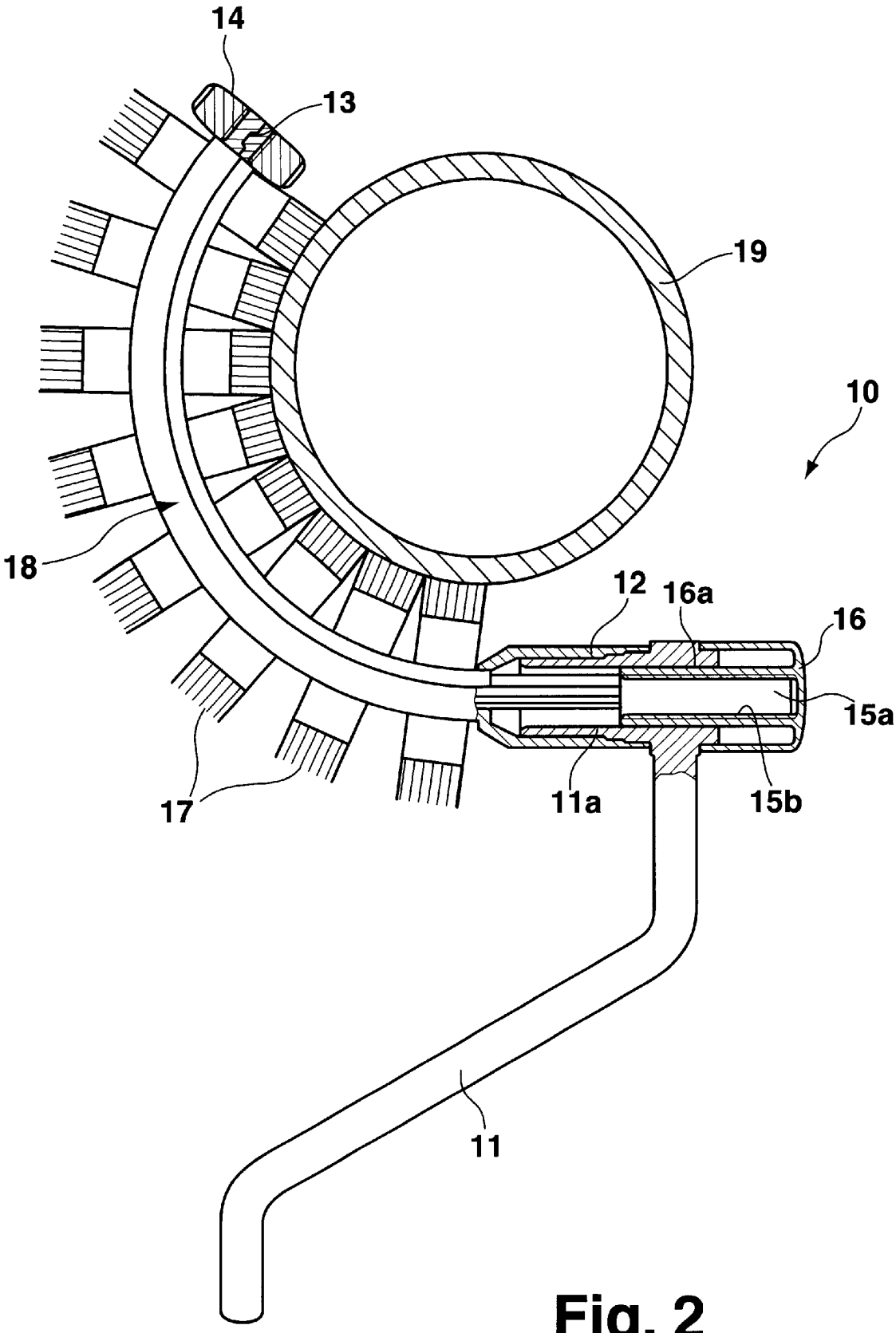
FIG. 2 shows the roller in accordance with FIG. 1 having a curved roller axle.

FIG. 1 shows the initial position in which the roller axle 18, formed from the two axle members 12*a* and 15, extends in a substantially linear fashion. After the user has removed the stop screw 14 and has placed paint application rollers 17 in the desired number and configuration onto the roller axle and once more screwed on the stop screw 14, the curvature of the roller axle can be adjusted. Towards this end, the user rotates the tension screw 16 as a result of which the thread 16*a* inserted in the bushing 11*a* is likewise rotated. Since the tension screw 16 is borne for rotation but held in an axially non-displaceable fashion, rotation of the thread 16*a* causes, via the engagement of thread 15*b* of the threaded section 15*a* of the second axle member 15, the threaded section 15*a* to be axially pulled into the bushing 11*a*. The second axle member 15, integrally connected to the threaded section 15*a*, is likewise pulled into the bushing 11*a* so that the free protruding length is shortened. The shortening of the protruding length of the second axle member 15 introduces, via the engagement nose 13 on the opposite front end of the roller axle 18, an eccentric pressure force into the first axle member 12*a* as result of which the entire roller axle is curved in such a fashion that the smaller radius of curvature is disposed on the side of the second axle member 15. FIG. 2 shows the paint roller in its position of maximum roller axle curvature, wherein the threaded section 15*a* of the second axle member 15 is pulled to the furthest extent possible into the tension screw 16. The outer surface of a pipe 19 can be easily painted as suggested in FIG. 2 using a paint roller with this type of curved roller axle which is nevertheless fixed in its curved position.

Figure 3:
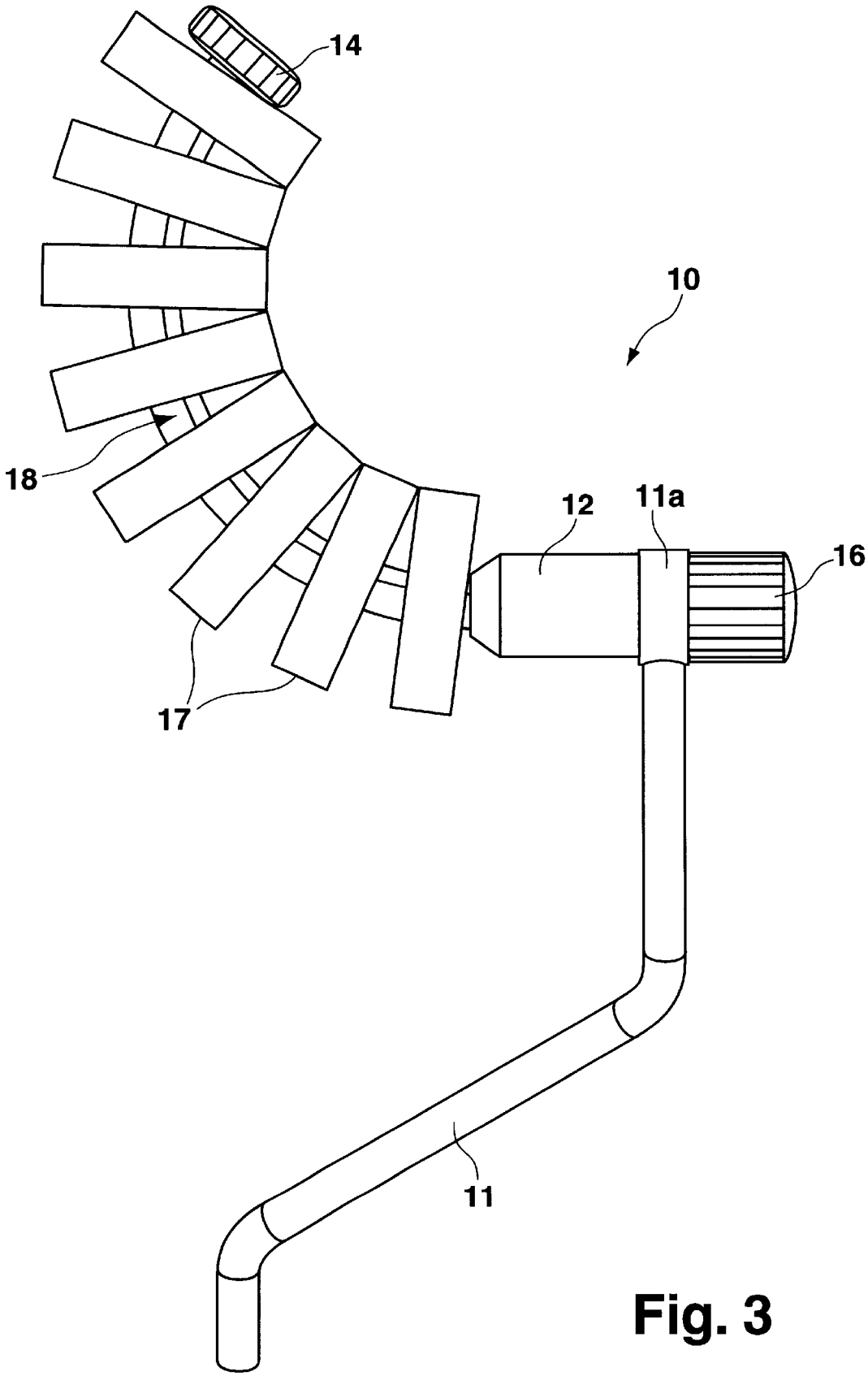
FIG. 3 shows the paint roller in accordance with FIG. 1 in plan view.
Figure 4:
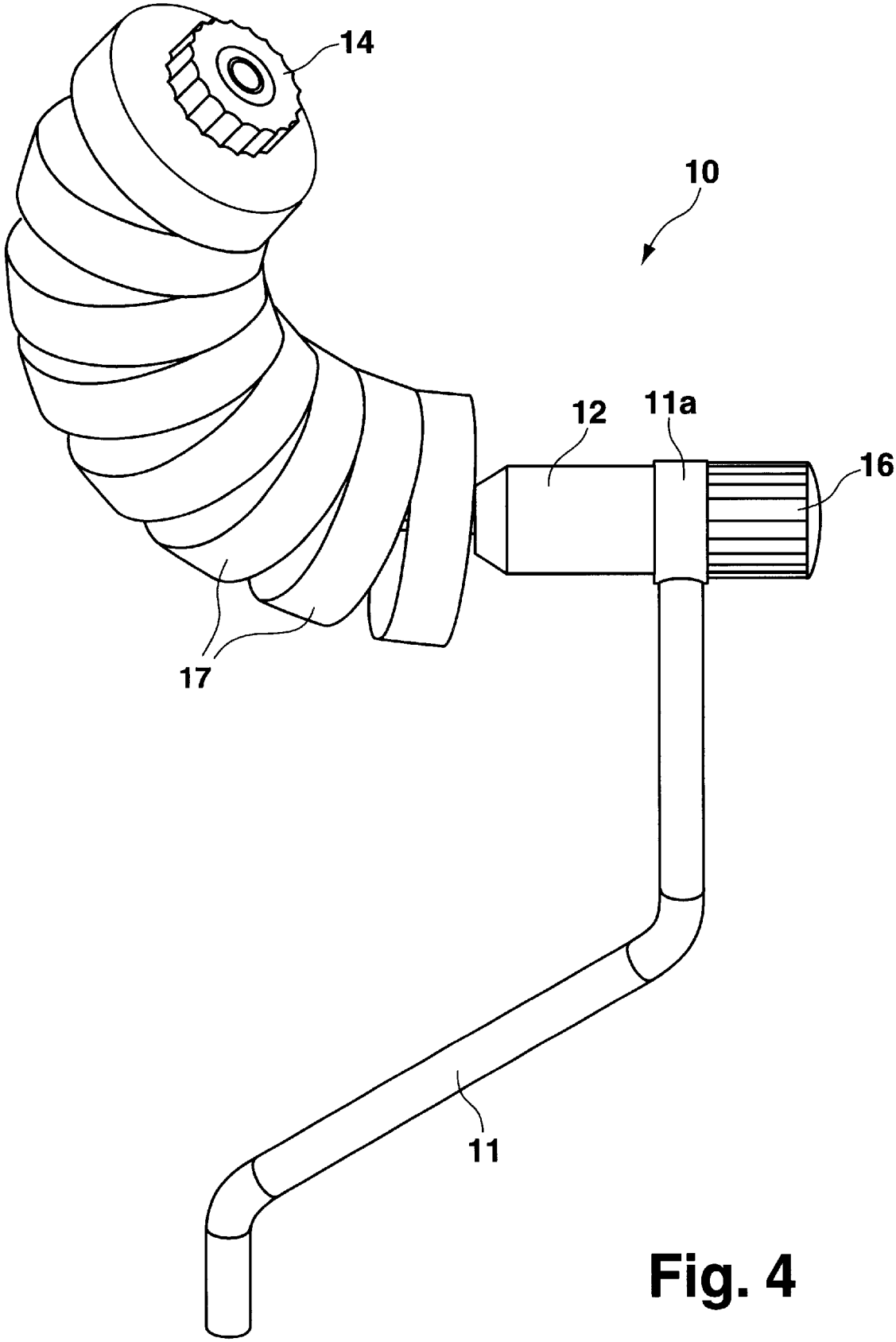
FIG. 4 shows the paint roller in accordance of FIG. 3 having a changed direction of the roller axle relative to the support arm.

The roller axle can be curved in a single plane through shortening of the second axle member 15 by pulling it into the bushing 11*a*, while maintaining the length of the first axle member 12*a*. Since this plane does not represent the optimal orientation relative to the handle or to the support arm of the paint roller for all applications, it is possible to change the orientation of the curved roller axle along with the paint application rollers held thereby 17, relative to the support arm 11. FIG. 3 shows a view of the paint roller shown in section in FIG. 2 with which the curved roller axle and the support arm 11 substantially lie in a common plane. By pivoting the bushing member 12 together with the two axle members 12*a* and 15 about the bushing 11*a* of the support arm 11, it is possible to change the orientation of the roller axle and thereby that of the paint application rollers relative to the support arm 11. FIG. 4 shows a view of the paint roller according to FIG. 3 with which the roller axle has been adjusted in a peripheral direction through 45°. A total of 8 pivot positions in which the bushing member 12 is in positive engagement with the bushing 11*a* are preferentially provided about the periphery having mutual angular separations of 45°.

As can be seen from the above mentioned discussion, a user can appropriately rotate the tension screw 16 to pull the threaded section 15*a* of the second axle member 15 by a desired amount into the bushing 11*a* of the support arm 11 to thereby adjust the curvature of the roller axis in an arbitrary and continuous fashion.

In order to exchange the roller axle, the threaded engagement between the threaded section 15*a* and the tension screw 16 is released and the bushing member 12 is axially removed from the bushing 11*a* so that a new roller axle having a differing length and/or with differently shaped paint application rollers can be placed onto the bushing 11*a* of the support arm 11 along with its associated bushing member.

In the assembled state, the stop screw 14 is disposed in such a fashion that the engagement between the two axle members 12*a* and 15, via the engagement nose 13, lies in the region covered by the stop screw 14 so that an unintentional release of the engagement between the two axle members 12*a* and 15 is avoided though positive interlocking.

I claim:

1. A roller device for the application of a medium, comprising:

a support arm;

a roller axle borne on said support arm, said roller axle having an adjustable curvature;

at least one application roller borne on said roller axle for rotation; and adjustment means communicating with said roller axle for adjusting said curvature and for locking said roller axle in an adjusted, curved orientation.

2. The roller device of claim 1, wherein said adjustment means exercises a flexural moment on said roller axle, said flexural moment having a magnitude which is continuously variable.

3. The roller device of claim 1, wherein said roller axle comprises at least a first and a second axle member, said first axle member adjacent to and parallel with said second axle member, wherein said adjustment means cooperates with at least one of said first and said second axle members to adjust said first axle member relative to said second axle member.

4. The roller device of claim 1, wherein said first axle member is connected to said second axle member at at least one section, wherein said curvature of said roller axle is changed through shortening or lengthening of at least one of said first and said second axle members.

5. The roller device of claim 4, wherein said first and said second axle members are in mutual engagement at a free end facing away from said support arm.

6. The roller device of claim 3, wherein said adjustment means comprises a tension screw in threaded engagement with at least one of said first and said second axle member.

7. The roller device of claim 3, wherein said curvature of said roller axle is changed by introducing a pressure force or a tension force on at least one of said first and said second axle member.

8. The roller device of claim 1, wherein said roller axle is brought into differing pivoting positions relative to said support arm.

9. The roller device of claim 8, wherein said roller axle is latched into said pivot positions.

10. The roller device of claim 1, wherein said roller axle is held in a detachable fashion on said support arm.

11. The roller device of claim 1, wherein said at least one application roller is held on said roller axle in an exchangeable fashion.

12. The roller device of claim 1, wherein said application roller consists essentially of a plurality of substantially coaxially disposed roller members.

13. The roller device of claim 1, wherein the roller device is flexible.

14. The roller device of claim 1, wherein the roller device it is made completely from plastic.

* * * * *